United States Patent [19]

Heimala

[11] 4,243,499

[45] Jan. 6, 1981

[54] PROCESS FOR ELECTROLYTIC RECOVERY OF ZINC FROM ZINC SULFATE SOLUTIONS

[75] Inventor: Seppo O. Heimala, Pori, Finland

[73] Assignee: Outokumpu Oy, Helsinki, Finland

[21] Appl. No.: 105,557

[22] Filed: Dec. 20, 1979

[30] Foreign Application Priority Data

Dec. 22, 1978 [FI] Finland ..... 783984

[51] Int. Cl.[3] ..... C25C 1/16

[52] U.S. Cl. ..... 204/119

[58] Field of Search ..... 204/119

[56] References Cited

U.S. PATENT DOCUMENTS

| | | | |
|---|---|---|---|
| 1,299,414 | 4/1919 | Aldrich et al. | 204/119 |
| 2,509,917 | 5/1950 | Griffith et al. | 204/119 |
| 2,913,377 | 11/1959 | Brown | 204/119 |
| 3,826,648 | 7/1974 | Bodson | 204/119 |

*Primary Examiner*—R. L. Andrews

*Attorney, Agent, or Firm*—Brooks, Haidt, Haffner & Delahunty

[57] ABSTRACT

A process for electrolytic recovery of zinc from zinc sulfate solutions according to the electrowinning principle, using an aluminum cathode and a zinc sulfate solution which is devoid of any organic substance and to which at least one of cobalt and nickel has been added in such an amount that the solution contains nickel less than 2 mg/l and cobalt less than 5 mg/l.

5 Claims, 2 Drawing Figures

Zn-ELECTROLYSIS FROM A Co-Ni-CONTAINING SOLUTION

PROCESS FOR ELECTROLYTIC RECOVERY OF ZINC FROM ZINC SULFATE SOLUTIONS

BACKGROUND OF THE INVENTION

The present invention relates to a process for electrolytic recovery of zinc from zinc sulfate solutions according to the electrowinning principle, using an aluminum cathode.

It is previously known to recover zinc electrolytically according to the electrowinning principle by using a silver-bearing lead anode and as the electrolyte a zinc sulfate solution which contains zinc 50–65 g/l and sulfuric acid 100–180 g/l. The cathodes used in this case are aluminum sheets on which zinc is deposited electrolytically. The zinc is allowed to accumulate on the aluminun sheets for 24 h, operating with a current density of 450–600 amp/m$^2$, which has been found in practice to be good. Thereafter, the cathodes are lifted out and the zinc is detached from them. Finally the zinc plates are fed, together with slagging ammonium chloride, into the casting furnace for the casting of zinc bars.

When the objective is to deposit pure zinc, keeping the power supply as high as possible, the traditional method is to use as pure electrolytic solutions as possible. It has been a general belief that Ge, Sb, As, Se, Fe, Co and Ni have an especially adverse effect on zinc electrolysis. A careful removal of all impurities from the solutions is, however, expensive and makes the process uneconomical.

When zinc is precipitated from an impure solution, zinc first deposits as an even layer on the cathode surface. After some time the surface begins to grow unevenly. So-called dendrites (FIG. 1) are formed on the surface. Impurities, which usually have a lower hydrogen overvoltage than zinc, deposit around the dendrites. The spot-like difference in voltage between the impurity deposit and the zinc deposit results in that, when impurities deposit, zinc begins to pass back into the solution, and at the same time hydrogen is generated. The total current afficiency $\eta_{tot}$ is the sum of the zinc current efficiency $\eta_{Zn}$ and the hydrogen current efficiency $\eta_H$, i.e. $\eta_{tot}=\eta_{Zn}+\eta_H$.

Since hydrogen is produced in the "miniature electrolysis" occurring at the impurity sports around the dendrites, the current efficiency of zinc is lowered. The effect of these reactions becomes so important that it is futile to continue the electrolysis, and the cathodes are lifted out of the solution.

In attempts at preventing impurities such as dendrites from depositing on the cathode surface, various organic compounds are generally added to the solution, but also "neutral" inorganic compounds such as sodium silicate, $Na_2SiO_3$. The effect of the additives, preventing the growth of dendrites, is explained to be due to the adsorption of the additive to the cathode surface, whereby the growth of Zn crystals is prevented and new nucleation spots are produced. Thereby the crystal structure of the zinc becomes finer and the surface more even. Another aim in using additives is the formation of a foam which prevents evaporation on the surface of the electrolytic tank. However, practice has shown that additives also decrease the current efficiency, and especially if longer growth periods are the aim, maintaining a high current supply is very difficult.

In known processes, efforts are made to maintain, as low as possible, the impurity content in the solution entering the Zn electrolysis, for example, Co and Ni within the range 0.1–0.2 mg/l. Electrolytic Zinc Co of Australasia uses an electrolytic solution which contains 10 mg/l Co, but the cobalt is combined in an organic complex ($\alpha$-nitroso-$\beta$-naphthol), and so cobalt is not actually in the solution and consequently the crystal structure and the surface quality are similar to those in a normal system.

The object of the present invention is, therefore, to provide a process for electrolytic recovery of zinc from zinc sulfate solutions, with an improved current supply.

SUMMARY OF THE INVENTION

According to the present invention current supply is increased by carrying out the electrolysis using a zinc sulfate solution which is devoid of any organic substance and to which cobalt, nickel or both has been added, but at such a rate that the solution contains nickel less than 2 mg/l and cobalt less than 5 mg/l.

DESCRIPTION OF THE PREFERRED EMBODIMENTS

Figure 1:
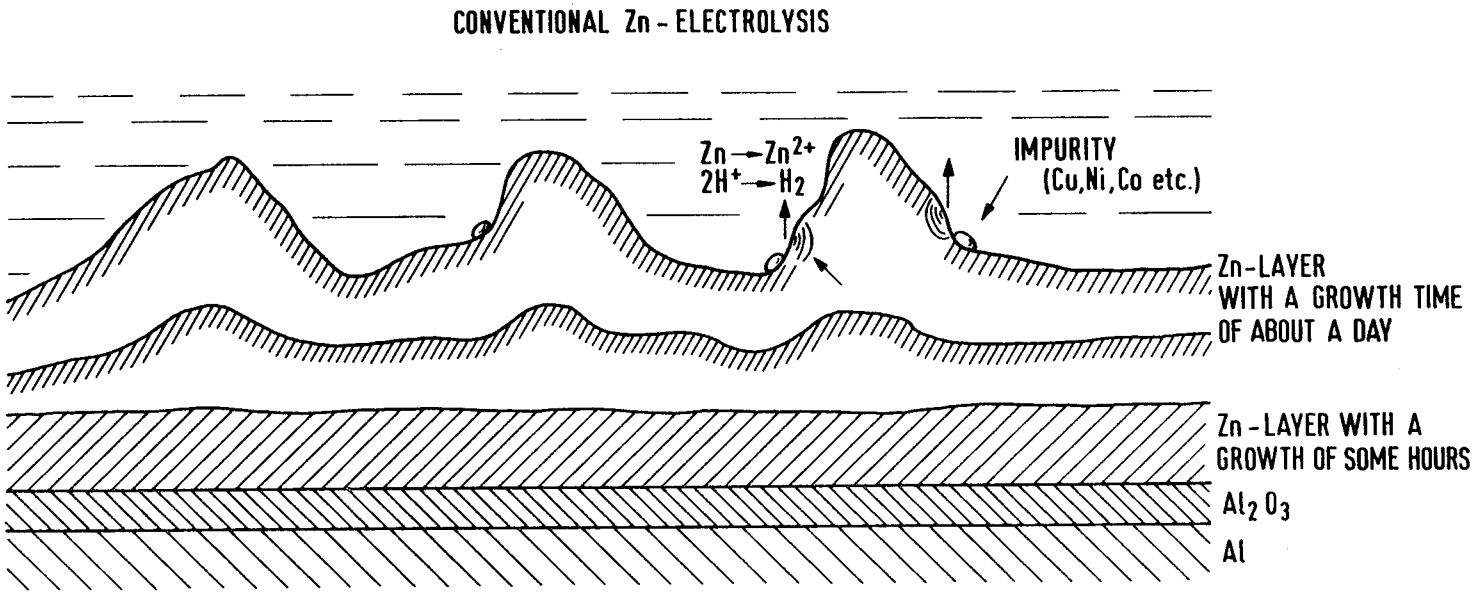
FIG. 1 shows a zinc deposit from a conventional electrolyte.
Figure 2:
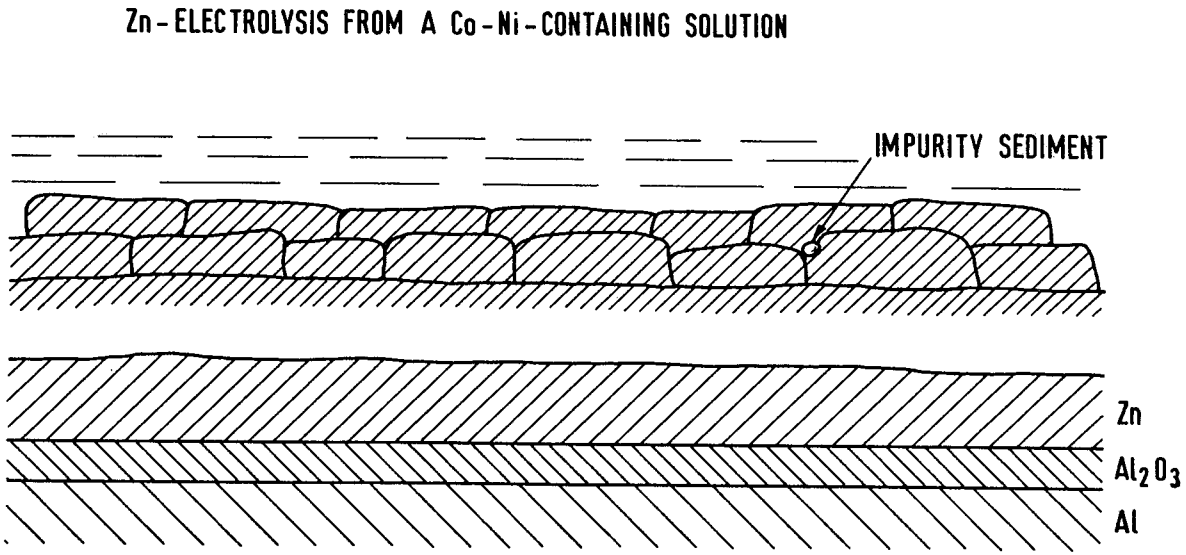
FIG. 2 shows a zinc deposit from a Co - Ni electrolyte.

Surprisingly, it has now been observed that if the cobalt-nickel level is maintained high in comparison with normal usage and all additives are omitted, the results obtained are considerably better than previously obtained. In the processes normally used the current efficiency decreases after the first 24 hours so much that it is no longer beneficial to increase the zinc layer, and the cathodes are lifted out of the solution. As was noted above, it has been necessary to add additives to the electrolytic solution in order to prevent the decreasing of the current efficiency by impurities. In the process now used, cobalt and/or nickel was added to the solution at such a rate that the Co concentration was over 0.2 mg/l, preferably over 0.5 mg/l, e.g. 2–4 mg/l, and the Ni concentration over 0.2 mg/l, preferably over 0.5–2 mg/l. As a result, the current efficiency increased by a couple of percent over that of pure solution, and this current supply continued to be high even though the depositing period was increased. In a closer inspection it was, furthermore, observed that the zinc had deposited on the cathode in a different manner. In a process carried out in the normal manner. zinc begins to form dendrites, but zinc depositing from a Co-and Ni-bearing solution deposits as a structure with a surface resembling slabs. In appearance, this differs from conventional electrolytic zinc by its shiny surface (FIG. 2). The addition of cobalt and nickel to the solution thus alters the stacking pattern of zinc. In this system, the impurities, if any, obviously remain inside the growing structure and not on its edges as in normal electrolysis in which they can cause disolution of zinc and generation of hydrogen. Another group of factors effective in the process according to the invention derives from the anode size. The most essential advantage of the process over the previous one is that the elimination of the impurities results in a high current efficiency even when long depositing periods are used. If a zinc plant can shift from stripping once a day to stripping once every two days or three days, the advantage gained is considerable. If it is possible in a large-scale production plant to increase the current supply by, for example, approx. 1%, the financial advantage gained is considerable.

The invention is described below in more detail with the aid of examples.

EXAMPLE 1

The experiments were performed using a synthetic zinc sulfate solution which had been obtained by dissolving pulverous Zn in a dilute sulfuric acid. The sulfuric acid used was pure and the water used for the dilution was distilled water. Nevertheless, the results obtained were directly proportional to results obtainable under process conditions.

Composition of the electrolyte:

| | |
|---|---|
| $H_2SO_4$ | 150 g/l |
| Zn | 55 g/l |
| $Mn^{2+}$ | 2 g/l |

The salts used were lead anodes containing 0.75% Ag, temperature was 35° C., current density 650 A/m$^2$, and depositing period 48 h.

In the first experiment, no additives were added to the electrolyte, in the second one heavy-froth liquid "Meteor" was used at 10 mg/l. In the third experiment, cobalt and nickel were added to the electrolyte so that their concentrations were 0.5 mg/l and 0.5 mg/l Ni.

The results are shown in the table below.

| Electrolyte | Current efficiency $\eta$ |
|---|---|
| No additives | 91.8 |
| Meteor 10 mg/l | 90.4 |
| Co—Ni 0.5 mg/l | 93.8 |

EXAMPLE 2

The zinc and sulfuric acid concentrations in the initial solution were the same as in Example 1. The initial solution also contained a normal amount of cobalt and nickel (0.1–0.2 mg/l), which are present as impurities in the electrolyte. To this electrolyte, either cobalt or nickel was added at such a rate that the final concentration of this added substance increased to the value given in the table below.

EXAMPLE 3

The $H_2SO_4$ concentration in the initial solution was 135 g/l and its Zn concentration 78 g/l. Co was added to the electrolyte at 1 mg/l, and a 45-hour electrolysis was run at 35° C. (650 A/m$^2$), maintaining the metal concentrations constant. The deposited Zn was bright and very pure. The current supply (Zn) was 95.7%.

EXAMPLE 4

Zn electrolysis was performed as in Example 3, but the $H_2So_4$ concentration was maintained at 175 g/l and the Zn concentration at 40 g/l. The current supply to zinc was 92.4%.

| Experiment | Time | Additive | Total concentration | Current efficiency |
|---|---|---|---|---|
| 1 | 24 h | Co | 2.0 mg/l | 93.9 |
| 2 | | Ni | 2.0 mg/l | 58.3 surface very uneven |
| 3 | | Co | 4.0 mg/l | 91.5 |
| 4 | | Ni | 0.5 mg/l | 91.1 |
| 5 | 50 h | Co | 0.5 mg/l | 95.6 |
| 6 | 5 days | Co | 0.5 mg/l | 93.1 |

What is claimed is:

1. A process for electrolytic recovery of zinc from zinc sulfate solutions according to the electrowinning principle, using an aluminum cathode comprising using a zinc sulfate solution which is devoid of any organic substance and to which cobalt, nickel or both has been added, but at such a rate that the solution contains nickel less that 2 mg/l and cobalt less than 5 mg/l.

2. A process according to claim 1, in which the solution contains cobalt more than 0.5 mg/l, preferably 2–4 mg/l.

3. A process according to claim 1, in which the solution contains nickel 0.5–2 mg/l.

4. A process according to any of the above claims, comprising using a silver-containing lead anode and depositing zinc on the aluminum cathode for att least 24 h at an elevated temperature, of at least 35° C.

5. A process according to claim 1, 2 or 3, in which the solution contains zinc 45–80 g/l and $H_2SO_4$ 100–180 g/l.

* * * * *